United States Patent [19]

Johnson

[11] 4,007,583

[45] Feb. 15, 1977

[54] ELECTRONIC TIMEPIECE

[75] Inventor: Edward Oscar Johnson, Princeton, N.J.

[73] Assignee: RCA Corporation, New York, N.Y.

[22] Filed: May 22, 1975

[21] Appl. No.: 579,962

[52] U.S. Cl. ..... 58/50 R; 58/23 R; 58/127 R

[51] Int. Cl.[2] ..... G04B 19/24

[58] Field of Search ..... 58/23 R, 50 R, 58, 127 R; 340/336, 179 C; 315/84.6

[56] References Cited

UNITED STATES PATENTS

| | | | |
|---|---|---|---|
| 3,258,906 | 7/1966 | Demby | 58/23 R |
| 3,456,152 | 7/1969 | Anderson | 315/84.6 |
| 3,540,209 | 11/1970 | Zatsky | 58/50 R |
| 3,717,990 | 2/1973 | Fujita | 58/50 R |
| 3,738,099 | 6/1973 | Tanaka | 58/50 R |
| 3,754,392 | 8/1973 | Daniels | 58/50 R |
| 3,772,847 | 11/1973 | Lefkowitz | 58/50 R |
| 3,823,549 | 7/1974 | Feldman | 58/50 R |
| 3,844,105 | 10/1974 | Kashio | 58/23 R |
| 3,889,458 | 6/1975 | Kashio | 58/50 R |
| 3,955,354 | 5/1976 | Kilby et al. | 58/50 R |
| 3,958,409 | 5/1976 | Manber | 58/50 R |

*Primary Examiner*—L. T. Hix
*Assistant Examiner*—Vit W. Miska
*Attorney, Agent, or Firm*—H. Christoffersen; Samuel Cohen; Michael A. Lechter

[57] ABSTRACT

The electrooptic display of an electronic timepiece has a total of only twelve indicator elements. Hours are indicated by causing one element to produce one kind of optical output such as steady illumination. Minutes are indicated by causing an element to produce another kind of optical output such as intensity modulated illumination. The particular element selected for intensity modulation is a coarse indication of minutes (5 minute increments); the modulation itself is a fine indication of minutes (1 minute increments). Similar techniques may be employed for indicating the month and day.

10 Claims, 7 Drawing Figures

ELECTRONIC TIMEPIECE

The traditional hours-minute hands type of display (a form of "analog" display) has enjoyed long use because it is particularly adaptable to mechanically driven time keeping systems and also is easily readable and comprehended by the general user. Despite much recent activity in the field of, and publicity about, digital-type displays (such as those employing seven-segment numeric indicators), brought about by recent dramatic advances in solid-state electronics, many still believe the analog displays will continue to be popular. They believe this to be so because they feel that such displays present data which is more quickly comprehended and retained by the user than that which is digitally presented.

While there have been a number of suggestions in the art for electronic implementation of the mechanical analog display described above, none is yet in evidence in today's electronic timepiece market. Rather the electrooptic displays now in use, whether they employ light emitting diodes (LED's), liquid crystal (LC) or other electrooptic material, are all of the digital type, so far as is known.

One of the technical problems in the practical realization of an electrooptic analog display is that, if conventionally implemented, sixty or more display elements are required to provide a complete representation of hours and minutes. This large number of elements presents formidable lead interconnection and reliability problems. In the case of LED's, which are relatively expensive, the large total semiconductor chip area of the display elements in a conventionally implemented analog display would mean that the watch would be very expensive.

There have been a number of proposals in the watch art for reducing the number of indicators in analog and other types of display. For example, U.S. Pat. No. 3,145,526 to J. J. Kroon suggests using two rings of light emitting diodes with 12 elements in each ring, the inner ring for indicating hours and the outer ring for indicating minutes in 5 minute increments. The total number of indicators is twenty-four and this is a considerable improvement over the 60 discussed above. U.S. Pat. No. 3,841,082 to J. W. Cuevas suggests employing four binary coded indicators for hours, four binary coded indicators for 5 minute intervals and four indicators for one minute intervals. This reduces the total number of indicators to twelve but the display is not really an analog display. Rather, the observer has to translate a binary coded indication to hours and 5 minute intervals and this, of course, complicates the problem of comprehension to say the least.

Returning to the LED displays, especially those of the digital type, there is a problem of power consumption. To many viewers such displays have a pleasant appearance; however, where only limited power is available as, for example, in wrist-watches, it is necessary that the display be off most of the time. When the wearer wishes to observe the time, he must actuate a switch to energize the display. Interestingly, a large portion of the LED power drain problem resides in the readout inefficiency of the digital displays. In a four digit, seven-segment per digit display, the average number of segments lit at any time throughout a 24 hour period of a day is slightly in excess of 14 (assuming continuous operation of the display). The power drain problem is further aggravated by the necessity of having each segment of at least a certain size and shape to make the digits readable.

In embodiments of a timepiece display in accordance with the present invention, means are provided for selectively energizing the electrooptic indicators to produce intensity-modulated, optically observable outputs, the modulation conveying time information.

Figure 1:
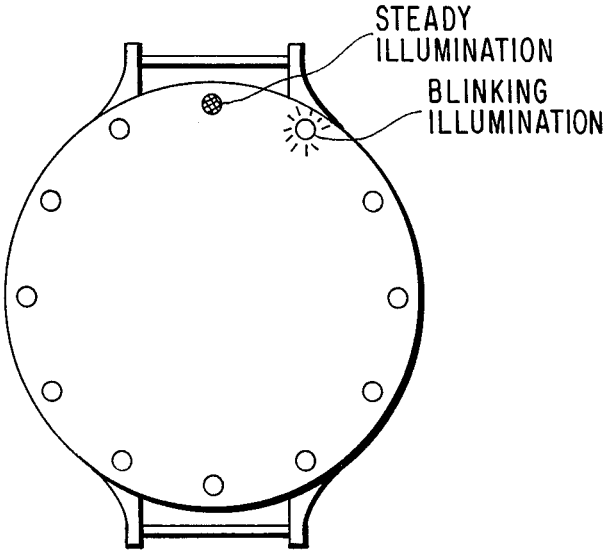
FIG. 1 is a schematic showing of an electrooptic display for a timepiece in accordance with an embodiment of the invention.

In the display of FIG. 1, there are twelve indicators, such as light emitting diodes, liquid crystals, lamps or other electrically operated, optically active elements. They are arranged in a circle and spaced from one another equal distances similarly to the hour markers on a watch or clock. While for purposes of illustration the indicators are shown to be circular, other shapes such as short radially-extending lines, squares and ovals, to give but a few examples, may be used instead. To indicate hours, one of the indicators is energized continuously. To indicate minutes, one of the indicators is intensity modulated to cause it to produce blinking "illumination". (As used here, the term "illumination" or "optical output" is intended to be generic to self-generated light such as produced, for example, by a LED, an electroluminescent element, a lamp or other light emitter, and to reflected or transmitted light as may be produced by a liquid crystal, in some cases (field effect type) with the aid of an analyzer and polarizer and in other cases directly.) The indicator selected to display minutes is a coarse indication of minutes, that is, it represents a 5 minute interval. Thus, the display of FIG. 1 is indicating a time of at least 5 minutes after 12.

Figure 2:
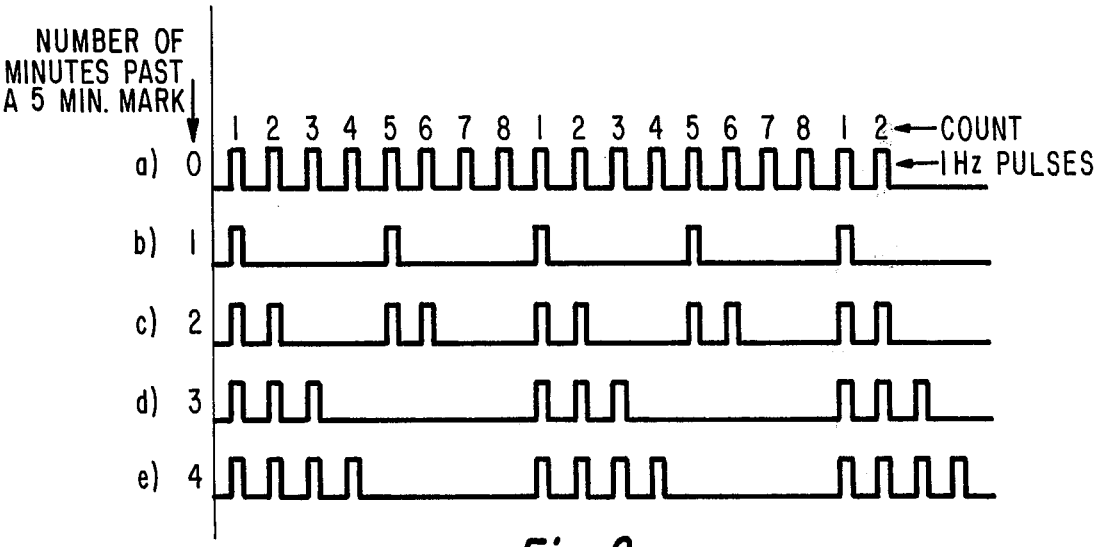
FIG. 2 is a drawing of waveforms which may be employed in the timepiece of FIG. 1 to produce intensity modulation of selected indicators.

The precise number of minutes after 12 is indicated by the modulation itself, as shown by the waveforms in FIG. 2. For example, if it is from exactly 5 minutes after 12 until almost 6 minutes after 12, the intensity modulation may be at a frequency of 1 Hertz (Hz). This is indicated in FIG. 2 at *a*, the notation 0 indicating that the time is less than 1 minute after the 5 minute mark. When it is desired to indicate 6 minutes after 12, the 5 minute marker is modulated as shown at *b* in FIG. 2. In other words, single pulses which recur at a frequency of one quarter Hz are applied to the 5 minute marker. To represent 7 minutes after 12, the pulses are grouped in twos. Thus, there are two pulses, then two spaces, then two pulses and so on. This is indicated at *c*, the number 2 indicating 2 minutes after the 5 minute mark. Eight and 9 minutes after 12 would be indicated by modulation as shown at *d* and *e* in FIG. 2. These five forms of modulation are intended as examples only as many other frequencies and groupings of pulses are possible and feasible. The same type of modulation as shown in FIG. 2 is employed for each 5 minute interval.

Once each hour, the hours and minute indications coincide in a manner analogous to that occurring in a conventional analog display when the minutes hand covers the hours hand. The solution of the present invention to this problem is to turn off the steady illumination. Thus, if the display shows only a blinking marker at the position corresponding to 2 o'clock, the observer recognizes that the time being displayed is between 10 and 14 minutes after 2 o'clock. If the time is 10 minutes after 2 o'clock (that is, less than 11 minutes after and at least 10 minutes after), the modulation is as shown at *a* in FIG. 2. If the time is 11 minutes after 2, the modulation is as shown in *b* in FIG. 2 and so on. At fifteen minutes after 2, of course, the indicator at the 2 o'clock position goes on steadily and the indicator at the 3 o'clock position starts blinking.

Figure 3:
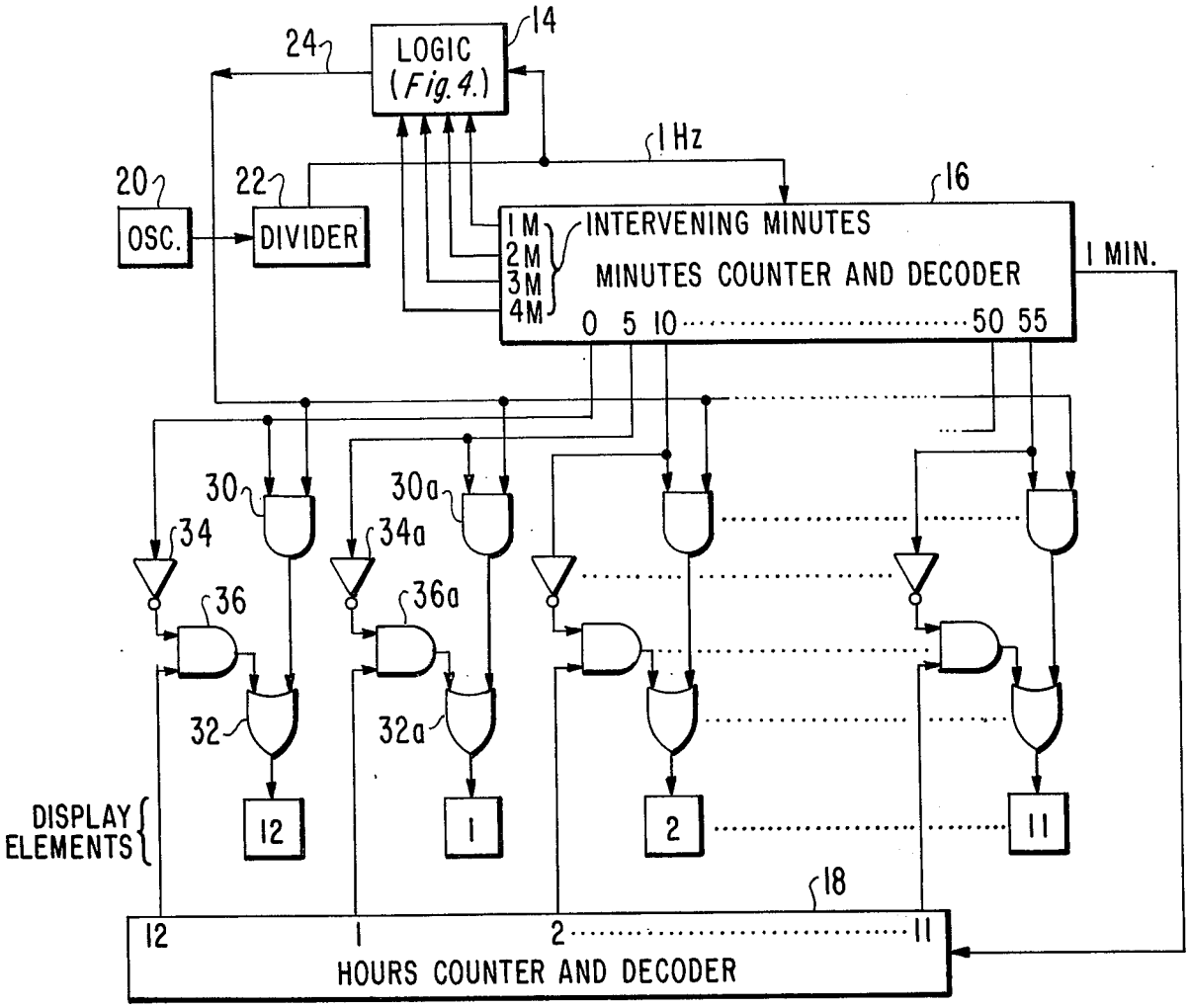
FIG. 3 is a block diagram of a portion of the circuit for driving the display of FIG. 1.

A circuit for driving the display is shown in FIG. 3. It includes an oscillator 20 which is crystal controlled and which operates at one of the standard clock frequencies such as 32+ KHz. The oscillator drives a frequency divider 22 which provides output pulses at a frequency of 1Hz. These signals are applied to logic circuits 14 and to minutes counter and decoder 16. The latter drives an hours counter and decoder 18. Circuits 16 and 18 operate a plurality of interconnected logic gates which drive the display elements shown as blocks in FIG. 3.

In the operation of the circuit of FIG. 3, the minutes counter and decoder 16 produces a high output (representing binary 1) at the 0 output terminal for the 0 to 5 minute interval of every hour. The remaining output terminals, 5, 10 . . . 50, 55 all have a low output (representing binary 0) during this period. Circuit 16 produces a high output at the 5 output terminal for the 5 to 10 minute period of each hour, the remaining outputs again being low, and so on.

Circuit 16 also produces the outputs 1M through 4M. These are legended "intervening minutes". None of these 4 outputs is high when the time is between exactly a 5 minute increment and 1 minute after this 5 minute increment. For example, no M output is high between 5 and 6 minutes after an hour, between 10 and 11 minutes after an hour, between 15 and 16 minutes after an hour and so on. The 1M output is high from 1 minute after a 5 minute increment to 2 minutes after that increment. For example, it is high between 6 and 7 minutes after an hour, between 11 and 12 minutes after an hour, and so on. In similar fashion, the 2M output is high during the 2 to 3 minute interval after a 5 minute increment; the 3M output is high during the 3 to 4 minute interval after a 5 minute increment; and the 4M output is high during the 4 to 5 minute interval after a 5 minute increment. In all of the cases above, it is to be understood that the lagging edge of an M output preferably occurs slightly before the leading edge of the following M output to avoid small overlapping indications of two different times.

The counter and decoder 18 receives pulses at a 1 minute rate from circuit 16. Circuit 18 produces a high output at its 12 output terminal for the hour 12 to 1; at its 1 output terminal for the hour 1 to 2 and so on. Only one output is high at a time, the remaining eleven outputs being low.

The logic circuit 14 (shown in detail in FIG. 4 which is discussed later) produces at output lead 24 the pulse patterns shown in FIG. 2. In other words, if none of the four outputs 1M to 4M is high, the pulses at *a* are produced. If 1M is high and the remaining outputs are low, the pulses at *b* are produced. If 2M is high and the remaining 3 "intervening minute" outputs M are low, the pattern shown at *c* is produced, and so on.

The logic gates for each of the 5 minute increment output leads from decoder 16 are identical so that only one group of such gates and its relationship to a second group of gates will be described. This one group includes an AND gate 30 followed by an OR gate 32. The group also includes an inverter 34 followed by an AND gate 36. Assume that the time is exactly 1 o'clock. The 0 output of the decoder 16 will be high and this primes AND gate 30. The remaining AND gates corresponding to 30 are disabled by the low outputs at 5, 10 . . . 55. The high output is also applied to inverter 34 which applies a low to AND gate 36, disabling the same. The pattern on lead 24 is that appearing at *a* in FIG. 2. This pattern is applied through primed AND gate 30 and OR gate 32 to the indicator, such as a light emitting diode, at the 12 o'clock position on the electrooptic display of the watch. Thus, this indicator blinks on and off at a 1Hz rate in a manner indicated at *a* in FIG. 2.

At this same time, the 5 output of the circuit 16 is a low so that AND gate 30*a* is disabled. However, inverter 34*a* primes AND gate 36*a*. The 1 output of hours counter and decoder circuit 18 is high at this time and all other outputs 2 – 12 are low. Accordingly, AND gate 36*a* and OR gate 32*a* are enabled and the indicator at the 1 location goes on steadily. Thus, the display is showing the time to be exactly 1 o'clock by having the 1 indicator on steadily and the 12 indicator blinking at the 1 Hz rate.

When the time reaches 1 minute after 1, all of the conditions will be exactly the same except that the signal on lead 24 will change from the pattern shown at *a* in FIG. 2 to the pattern shown at *b* in the same FIGURE. The new modulation on the 0 minute marker will indicate 1 minute after the hour.

Assume now that the time is exactly 12 o'clock. This is the condition corresponding to that when the minute hand is over the hour hand in a conventional mechanical watch. Now the output 12 of the hours counter and decoder 18 is high and all other outputs 1 – 11 are low. The 0 output of circuit 16 is high so AND gate 30 is primed. The pattern on lead 24 is that shown at *a* in FIG. 2 and this is the same signal that will appear at the output lead of gate 30. Inverter 34 disables AND gate 36. Accordingly, OR gate 32 applies the 1 Hz signal being produced by gate 30 to the 12 o'clock indicator. None of the other indicators will be on either steadily or in blinking fashion.

Figure 4:
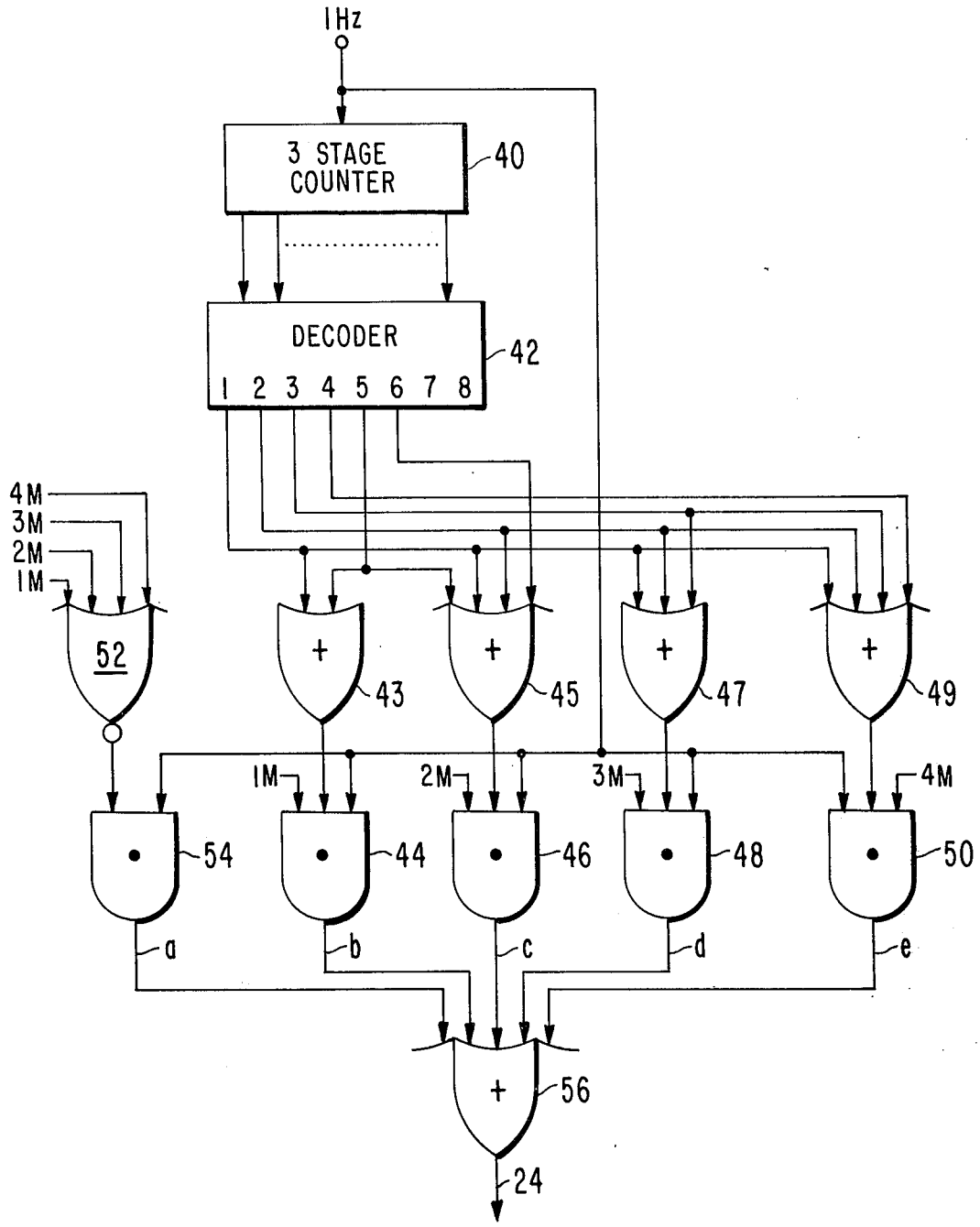
FIG. 4 is a block diagram showing in more detail the "logic" block of FIG. 3.

A more detailed showing of the logic circuit 14 appears in FIG. 4. It includes a 3-stage counter 40 which drives a decoder 42. The decoder output signals are applied in various ways through OR gates 43, 45, 47 and 49 to AND gates 44, 46, 48 and 50. The intervening minutes marker signals are applied in the way shown to these same AND gates and to NOR gate 52. The latter supplies its output to AND gate 54. The five AND gates drive OR gate 56 and lead 24 (of logic circuit 14 of FIG. 3) is the output lead of this OR gate.

In operation, assume that all of the intervening minute signals M are low. This disables AND gates 44, 46, 48 and 50 and enables NOR gate 52. The latter produces a high output which primes AND gate 54. The second input to this AND gate is the 1 Hz signal. Accordingly, AND gate 54 produces a 1 Hz output signal *a* and applies it via OR gate 56 to output lead 24.

Assume now that output 1M is high and the remaining signals 2M–4M are low. NOR gate 52 produces a low output which disables AND gate 54. The low signals 2M, 3M and 4M disable AND gates 46, 48 and 50, respectively. The high signal 1M primes AND gate 44. AND gate 44 becomes enabled each time the decoder 42 produces an output at its 1 output terminal and an output at its 5 output terminal and these occur at the counts of 1 and 5, respectively, assuming the 3 stage counter to continuously cycle through the counts 1 to 8. Thus, AND gate 44, which receives at its third input lead the 1 Hz signal, will produce an output in response to every fourth 1 Hz pulse it receives, as shown at *b* in FIG. 2. These pulses are applied through OR gate 56 to output lead 24.

The remaining AND gates 46, 48 and 50 operate in a manner quite analogous to that already discussed to produce the patterns *c*, *d* and *e* of FIG. 2. For example, at counts of 1, 2, 5 and 6 OR gate 45 is enabled so that AND gate 46 is primed. Accordingly, when 2M goes high, AND gate 46 produces the pattern *c* of FIG. 2.

In the embodiment of the invention described above, one of the indicators produces steady illumination and the other blinks. Additional power can be saved by blinking both the hours and the minutes indicator. To distinguish between hours and minutes, the blinking rates should be different. For example, the hours indicator can be blinked at a 4 Hz rate and the seconds indicator at the rates already discussed. Of course, there are many other possibilities.

In another form of the invention, the intensity of illumination can be made different to distinguish minutes from hours. For example, the hours indicator may be on faintly but steadily and the minutes may be on more brightly but in blinking fashion. Various permutations and combinations of light intensity and pulse coding may, of course, be employed.

Figure 6:
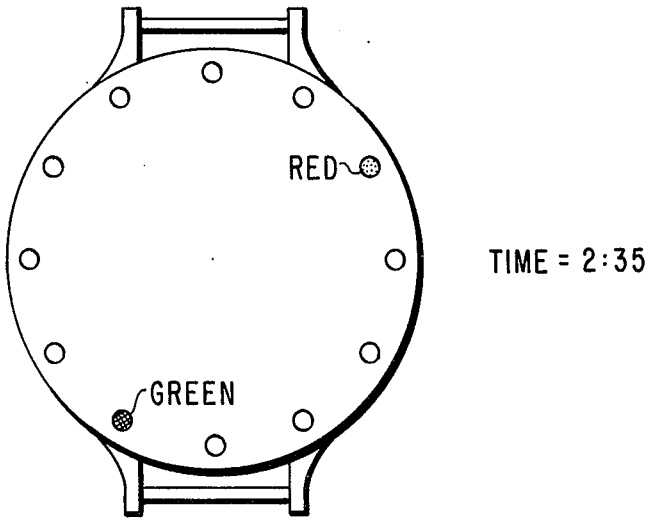

Color is another parameter that may be employed to better help distinguish between hours and minutes and also to provide more possibilities for different styling. A particularly advantageous way of introducing color without requiring extra display elements is to employ oxygen-doped gallium phosphide (GaP) display elements. These have a red color when operated at low currents and a greenish color when pulsed at high currents. Thus, by appropriate selection of current density and duty cycle, the hours element can be made to appear in red for example, and the minutes to appear in green, as illustrated in FIG. 6.

It is also possible to display minutes in a second way which may be termed "bracketing". Here, two 5 minute markers are employed. For example, to indicate 5 minutes after the hour, the 5 minute marker can be blinked and the 10 minute marker remain off. To indicate 6 minutes after the hour, the 5 minute marker can be blinked as at *b* and the 10 minute marker blinked as at *e*. To indicate 7 minutes after the hour, the 5 minute marker can be blinked as at *c* and the 10 minute marker as at *d* and so on. Alternatively, as time progresses between 5 and 10 minutes, the 5 minute marker can be made less bright and the 10 minute marker more bright. For example, at 6 minutes after the hour, the 10 minute marker can go on dimly and the 5 minute marker decrease slightly in brightness, and so on.

Figure 7:
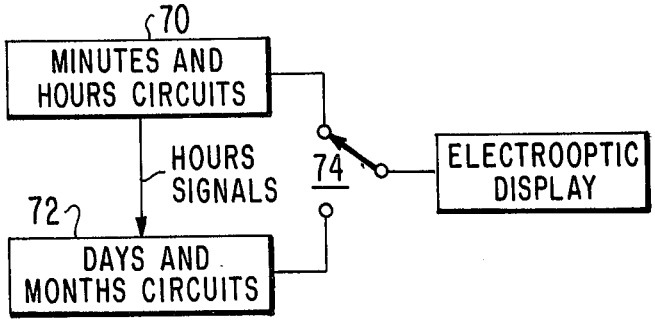
FIG. 7 is a block diagram of an embodiment of a calendar display system according to the invention.
Figure 5:
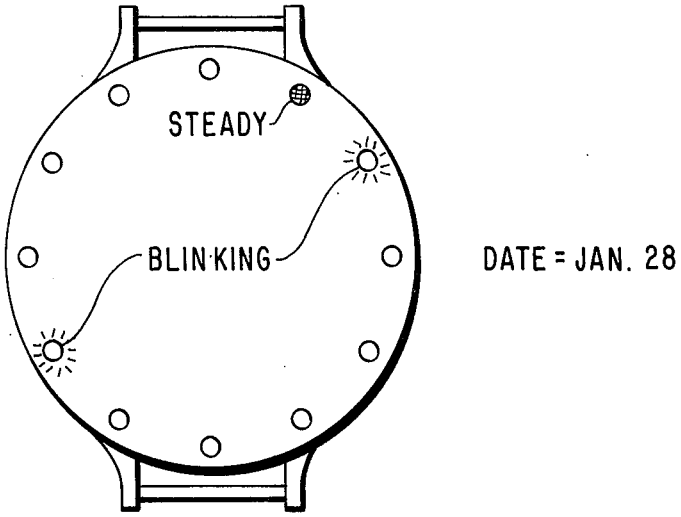
FIGS. 5 and 6 are schematic showings of other embodiments of electrooptic displays according to the invention.

It is also possible to provide a calander display in accordance with the invention in the manner shown in FIGS. 5 and 7. The entire system is shown in block form in FIG. 7 and includes "minutes and hours" circuits 70 such as shown in FIGS. 3 and 4 and "days and months" circuits 72 driven by one of the hours signals such as the 12 signal. The circuits 72 are quite analogous to the minutes and hours circuits 70 except that the time units being processed are longer, and to other so called "calendar" circuits known in the electronic watch art. The switch 74 is normally actuated to disconnect the display from the minutes and hours circuits and to connect it instead to the days and months circuit. (To simplify the drawing, the multiple conductors to and from the switch are shown as single lines).

The display may be the same one as shown in FIG. 1. With the indicators on in the manner shown, the display indicates the month of December (the 12th month) and the day 5 to 9, depending upon the modulation. If the modulation is as at *a*, the date is December 5'th; if as at *b*, the date is December 6'th and so on. In other words, the steady illumination indicates the month and the blinking illumination the day of the month.

FIG. 5 illustrates still another way that the date can be displayed. Here, the steady marker indicates the month (January in the illustration). Two markers are employed which can be turned on in sequence to illustrate the day. These two indicators can be blinked at the same rate such as 1 Hz. As the 2 and 8 indicators are blinking, the date is the 28th day of the month. The same technique as employed to tell time can be used when the month and day mark are the same, or sequential actuation of month, the day may be employed.

Returning to the display of time, additional power can be saved by blinking only the minutes indicator and displaying hours only on demand. This means that only the one indicator is on for the major part of the time and as it is being modulated, the amount of power needed is relatively considerably less than would be needed if that indicator were on steadily. There are many instances such as waiting for a train, or determining when an event as a concert or a program on television is to start, as examples, where the minute information is all that is needed.

What is claimed is:

1. An electronic timepiece comprising, in combination:

an electrooptical analog display comprising only 12 indicators spaced from one another in positions corresponding to the 12 hour markers on the face of a timepiece, said indicators occupying substantially similar areas and being of substantially similar shape and being distinguishable from one another, in their unactuated condition, only in their relative positions in the display; each indicator representing a different hour when employed to indicate hours, and each representing a different five minute increment when employed to represent minutes;

means for producing hours signals, one for each of the 12 hours making up a half day;

means for producing 5 minute signals, one for each of the 5 minute intervals making up an hour;

means responsive to the production of a five minute signal for selecting and actuating the one of the 12 indicators representing that 5 minute time interval for causing it to produce an optical output; and means responsive to the production of an hours signal, when that signal represents an hour different from that which would be indicated by the indicator actuated in response to said 5 minute signal, for selecting and actuating the indicator for that hour for causing it to produce an optical output which is optically distinguishable from the optical output produced by said actuated indicator for said 5 minute time interval.

2. An electronic timepiece as set forth in claim 1, wherein said means responsive to the production of a five minute signal comprises means for causing the five minute interval indicator selected to produce an optical output which is modulated at a rate sufficiently high to indicate to the user within an interval substantially less than a minute, the time increment represented by the modulation, and wherein said means responsive to an hours signal comprises means for causing the hours indicator selected to produce an optical output which remains steady during the time the five minute interval indicator is being modulated.

3. An electronic timepiece as set forth in claim 1, wherein said means responsive to the production of a five minute signal comprises means for causing the five minute interval indicator selected to produce an output in one color, and wherein said means responsive to an hours signal comprises means for causing the hours indicator selected to produce an output in a different color.

4. An electronic timepiece as set forth in claim 1, wherein said means responsive to the production of a five minute signal comprises means for causing the five minute interval indicator selected to produce an output at one intensity, and wherein said means responsive to hours signal comprises means for causing the hours indicator selected to produce an output at a second intensity, both intensities being non-zero.

5. An electronic timepiece as set forth in claim 1, further including:

means responsive to the concurrent presence of a five minute signal and an hour signal for the same indicator for suppressing one of said signals.

6. A electronic timepiece as set forth in claim 1, wherein said indicators comprise light emitting diodes.

7. An electronic timepiece as set forth in claim 1, further including:

means for producing signals indicative of months and days;

means for substituting for one of (a) the hours and (b) the five minutes signals, said signal indicative of the month for actuating one of the 12 indicators, to indicate one of the 12 months and for the other of *a* and *b*, said signal indicative of the day for actuating one or two of said 12 indicators, depending upon whether the day of the month has one or two decimal digits, to indicate the day of the month.

8. An electronic timepiece as set forth in claim 3 wherein said indicators comprise light emitting diodes of the type which emit light in one color when activated by one current density and which emit light in a different color when activated by current at a second density.

9. In an electronic timepiece having only twelve time markers spaced from one another in positions corresponding to those occupied by the hour markers on a conventional timepiece, each time marker comprising an electrooptical element, a method for displaying minutes comprising the steps of:

energizing a selected one of the time markers to denote a particular 5 minute increment of time;

modulating the selected marker in one of 5 different ways to indicate the one of the five 1 minute increments between that time marker and the following time marker it is intended to represent; and energizing a second selected one of the time markers, when it is different than the one selected to indicate minutes, to denote a particular hour in a half day, in a way such that its optical output is optically distinguishable from that of the time marker indicating minutes.

10. An electronic timepiece comprising, in combination:

an electrooptical analog display comprising 12 indicators spaced from one another in positions corresponding to the 12 hour markers on the face of a timepiece, each indicator representing a different hour when employed to indicate hours, and each representing a different 5 minute increment when employed to represent minutes;

means for producing hours signals, one for each of the 12 hours making up a half day;

means for producing 5 minute signals, one for each of the 5 minute intervals making up an hour;

means responsive to the production of a 5 minute signal for selecting and actuating the one of the 12 indicators representing that 5 minute time interval for causing it to produce an optical output;

means responsive to the production of an hours signal, when that signal represents an hour different from that which would be indicated by the indicator actuated in response to said 5 minute signal, for selecting and actuating the indicator for that hour for causing it to produce an optical output which is optically distinguishable from the optical output produced by said actuated indicator for said 5 minute time interval;

means for producing five different signals, indicative of zero-to-one, one-to-two, two-to-three, three-to-four, and four-to-almost 5 minutes, respectively, after the start of a 5 minute time interval; and means responsive to said five signals for modulating in five different ways, respectively, the one of said indicators selected to indicate a 5 minute interval.

* * * * *